United States Patent [19]

Fagundes

[11] Patent Number: 4,725,168

[45] Date of Patent: Feb. 16, 1988

[54] RETAINING WALL ANCHORING SYSTEM AND METHOD

[76] Inventor: Charles P. Fagundes, 700 Sharps Lot Rd., Swansea, Mass. 02777

[21] Appl. No.: 922,938

[22] Filed: Oct. 24, 1986

[51] Int. Cl.[4] ..... E02D 17/04; E02D 29/02

[52] U.S. Cl. ..... 405/262; 405/272; 405/285; 248/289.1

[58] Field of Search ..... 405/272, 282, 262, 284, 405/285; 248/289.1

[56] References Cited

U.S. PATENT DOCUMENTS

| | | | |
|---|---|---|---|
| 503,437 | 8/1893 | Pilcher | 405/282 X |
| 3,541,798 | 11/1970 | Schnabel | 405/262 |
| 4,139,324 | 2/1979 | Krings | 405/282 |
| 4,453,863 | 6/1984 | Sutton et al. | 405/282 |
| 4,472,090 | 9/1984 | Krings | 405/272 |

FOREIGN PATENT DOCUMENTS

| | | | |
|---|---|---|---|
| 2207319 | 1/1981 | Fed. Rep. of Germany | 405/282 |
| 366616 | 2/1932 | United Kingdom | 405/282 |

*Primary Examiner*—David H. Corbin

*Attorney, Agent, or Firm*—Robert J. Doherty

[57] ABSTRACT

A retaining wall anchoring system which includes a bracket assembly for mechanical removable positioning upon adjacent spaced retaining beams at a construction site. The bracket includes a first plate used for attachment to the beam and a body pivotally positioned therein on which a second plate is angularly positioned to present a square surface on which a rigid platform may be welded. The pivotal connection insures that the second plates can be positioned such that their receiving surfaces are in a common plane.

8 Claims, 5 Drawing Figures

RETAINING WALL ANCHORING SYSTEM AND METHOD

BACKGROUND AND OBJECTS OF THE INVENTION

This invention relates to a bracket for supporting a rigid anchoring platform used in connection with the retaining walls of an excavation. More particularly it deals with a bracket or bracket assembly used in pairs and which may be reusable to support a rigid anchoring platform which in turn is connected to a buried anchor behind the retaining wall and through which a rod or cable may be tightened so as to exert retaining force upon the walls.

During the construction of a large building such as a high-rise and the like, the excavation for the foundation and subfloors requires the presence of temporary lateral walls so that the adjoining earth, mud, etc. will not fall or flow back into the excavated site. Normally this is accomplished by driving supporting beams such as I-beams in spaced proximity to each other around the periphery of the excavation and then placing heavy planks or plates between the open U-shaped sections of the adjacent I-beams. These planks or plates form the retaining walls.

It is also normal and often necessary to further brace these walls by mounting rigid anchoring platforms which are connected to the outer faces of the I-beams and span adjacent I-beams. Connecting rods or cables are connected to these platforms. The other ends of the rods or cables are attached to a fixed weight or "dead man" embedded in the earth in back of and generally below the wall and below and, of course, at an angle to the position of the support. The end of the cable or rod attached to the support may then be tensioned by known means so as to exert a stabilizing force upon the walls via the I-beams such that the walls cannot move inwardly into the excavation. Generally these cables are called "ties" and the supports to which they are attached referred to as "tie back wales" although other nomenclature is common.

Generally the "tie back wale" or rigid support or platform takes the form of back to back channel irons with spacers welded between them or a modified I-beam although any rigid support spanning the adjacent beams may be utilized and for purposes of illustration in this invention may be assumed that such support is a flat, rigid member such as a steel elongated plate. In order to properly fix this anchoring platform or plate in position, it is necessary that it be rigidly attached to the I-beams at the opposite ends thereof and be positioned with respect to the outer face of the I-beams such that the face of the plate is at an acute angular relationship to the I-beams. This is necessary since the anchor is in back of and below the position the platform is attached to the I-beams to assure adequate holding force to the walls. Generally in present construction sites this requires that intermediate triangularly shaped plates be welded initially to the outer surface of the adjacent I-beams and then the rigid member positioned in contact with the slanted outer face of the intermediate plate and welded thereto. This system works properly if the adjacent I-beams being utilized are perfectly square with each other (that is, aligned so that their outer faces are in the same vertical plane) which is often not the case. Accordingly a considerable amount of trial and error welding, breaking the weld, repositioning, and rewelding is necessary at the construction site which is not only time consuming but also dangerous especially during wet weather or an overall wet environment at the construction site.

Accordingly it would be very desirable to be able to assure that the intermediate supporting members each and every time provide square and level surfaces for the support to be affixed to as by welding. This and other objects of the present invention which will become apparent hereinafter are accomplished by the bracket of the present invention. Such bracket includes a vertically oriented generally planar first plate having inner and outer faces, said first plate having means outwardly extending from said inner face for at least temporarily supporting said bracket upon the flat face of a beam such as an I-beam, a body member mounted on said first plate and projecting outwardly from the exterior surface thereof in a plane generally normal to said exterior surface, said body further mounted on said first plate for at least limited pivotal motion therewith, said body having a second plate fixedly attached thereto and disposed on the body side distal from its connection with said first plate, said second plate having an outer planar surface disposed at an acute angle to said first plate wherein appropriate pivoting of said bodies with respect to the first plates of a pair of brackets mounted on a pair of spaced beams disposes said second plates in the same plane for receipt of opposite ends of a rigid member such as an anchoring platform.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DETAILED DESCRIPTION OF THE INVENTION

Figure 1:
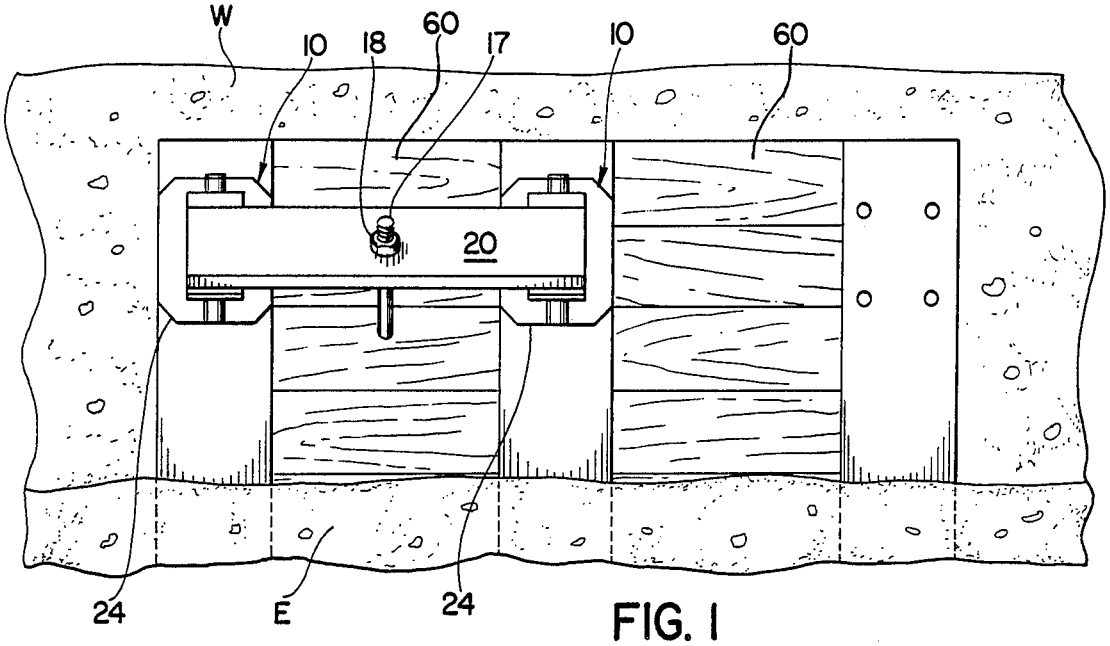
FIG. 1 is an elevational view of a portion of an excavation site wall in which two bracket assemblies of the present invention have been utilized to support a rigid anchoring platform spanning two adjacent beams.
Figure 2:
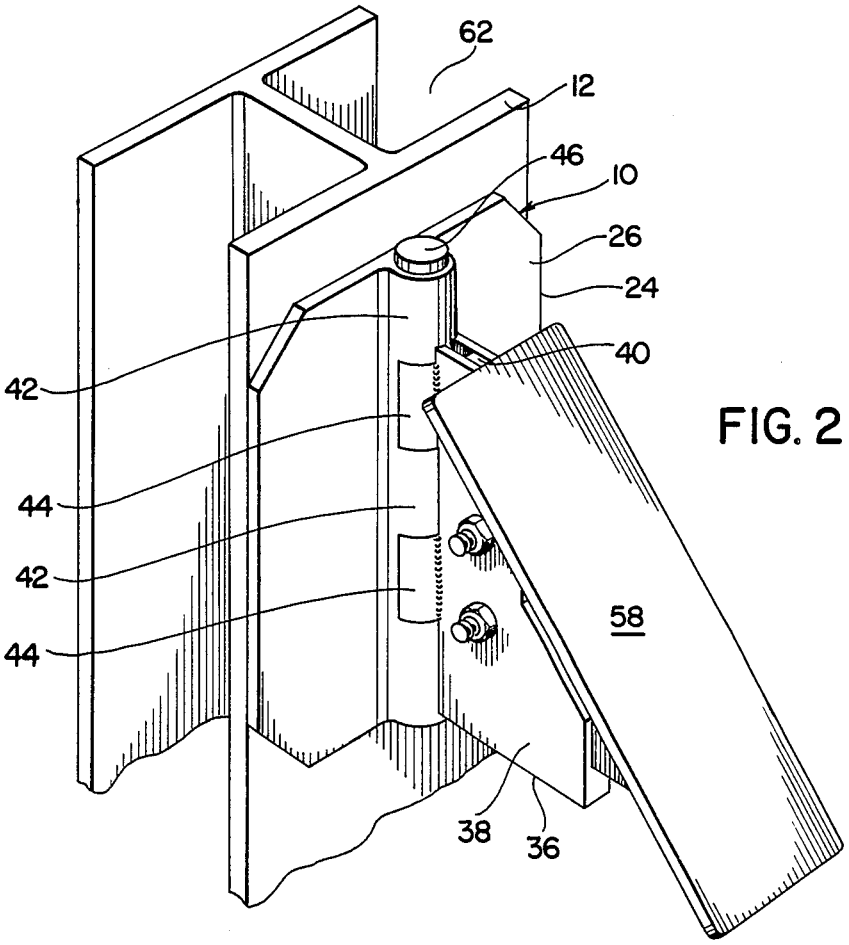
FIG. 2 is a partial perspective showing the bracket of the present invention mounted upon the face of a beam.
Figure 3:
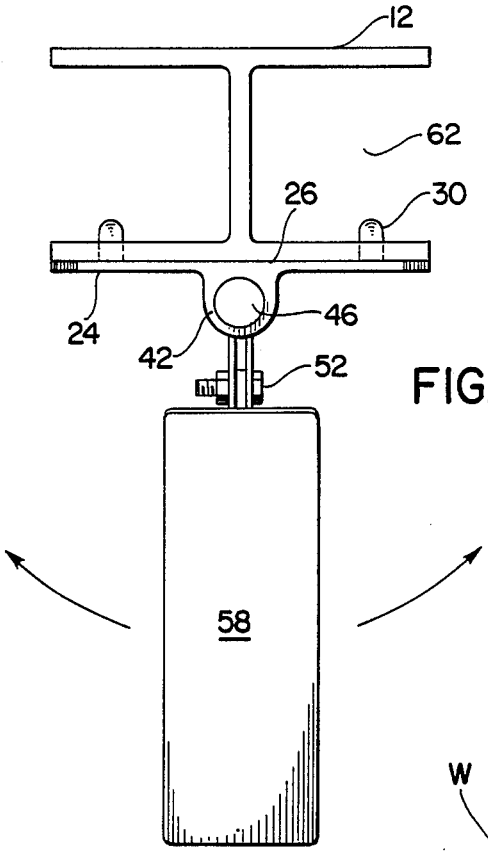
FIG. 3 is a top view of the bracket assembly shown in FIG. 2.
Figure 4:
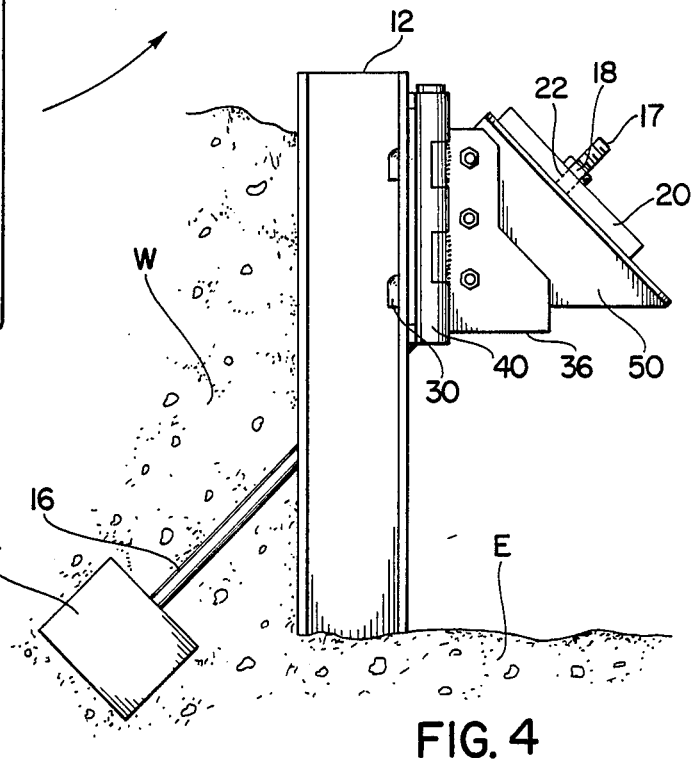
FIG. 4 is a side view thereof on a reduced scale and further showing the manner in which a cable or rod may be tied to a anchor buried behind the wall.
Figure 5:
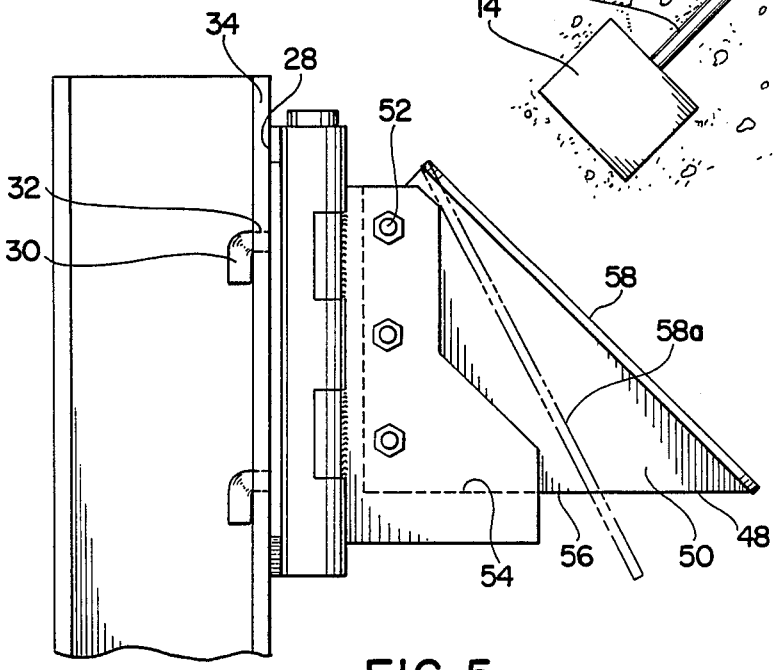
FIG. 5 is a side elevational view similar to FIG. 4 but on a larger scale and showing how differing shaped second plates may be utilized in conjunction with the bracket assembly so as to support the anchoring position in varied angular relationship to the beams.

Turning now to the drawings and particularly FIGS. 1 and 4, the overall excavation site environment in which the present bracket assembly 10 is utilized is best illustrated. Therein a pair of bracket assemblies 10 are shown in use position upon adjacent I-beams 12 embedded into the earth E at an excavation site. The I-beams 12 are normally embedded against earth walls W formed by the undug or back filled earth and in which an anchor or "dead man" 14 is buried. Such anchor can take the form of a block of precast concrete or poured in situ concrete in which a rod or cable 16 is permanently embedded at one end. The other end of the rod 16 is threaded and projects upwardly between the space between the adjacent I-beams 12 and into operative connection with a bolt 18 or other adjustment mechanism associated with a rigid anchoring platform 20.

For illustrative purposes, the platform 20 is shown as a horizontal unyielding beam extending between the bracket assemblies 10 and the adjustment mechanism is shown as a simple nut 18 threadably connected with the threaded end 17 of the rod 16. In that regard, the threaded end 17 passes through an opening 22 in the rigid member 20. It should be pointed out that although operative, this construction is primarily shown for illustrative purposes in that a more complex locking device forming part of a "tie back wale" and a more complicated anchoring platform both of which form no direct part of the present invention may be utilized. These are of known construction and presently in use in the construction trades at the present time. In that regard, one of the keys of the present invention is the use of the novel bracket assemblies such that the conventional "tie back wale" and anchoring platforms presently utilized can be more efficiently assembled at the construction site with both less effort and with the opportunity of use less skilled personnel in performing such tasks. This results in significant time and cost savings over the methods now utilized.

Such presently utilized methods involve the permanent welding of triangularly-shaped (generally a right triangle) bracket insert directly to the outer face of the adjacent I-beams 12. After such has been completed the anchor platform 20 or one of equivalent construction is positioned across the adjacent I-beams 12 and positioned on the slanted face of the triangular bracket. Inasmuch as the I-beams 12 are often canted or otherwise not square with respect to each other, it is often the case that the rigid platform 20 does not squarely sit upon or lie flush with the slanted edge of each bracket. This requires that the weld between the platform and the bracket or the bracket and the I-beam of either or both of the I-beams must be broken and re-welded. This must take place on the site, involves highly skilled and highly paid welders and involves a trial and error process that can take hours and, accordingly, hold up delay other workmen while assuring that the walls W are properly shored for continuing excavation or other foundation structual work on the project.

The use of the assembly brackets 10 of the present invention alleviate these problems in that it assures that a pair of support bracket surfaces are available such that the rigid platform will meet squarely with them and thus assures that only a weld need to take place between that surface and the rigid platform or in some cases even permits the mechanical fastening as by bolts of the rigid platform to the supporting surfaces.

Turning now to the drawings in general, the construction of each bracket assembly 10 will now be more fully explained. Therein each bracket includes a generally planar first plate 24 having an outer face 26 and a inner face 28. Outwardly extending from the inner face 28 are inwardly downwardly extending pins 30 adapted to extend into holes 32 formed in the outer surface of the I-beam outer face 34 and extend therebelow. Four such pins 30 are shown which cooperate with four openings in the I-beam face 34 such that the first pate 24 may be securely yet mechanically removably mounted upon the I-beam 12.

A body member 36 formed by a pair of panels 38 spaced from each other so as to form a slot 40 therebetween outwardly projects from the outer face 26 of the first plate 24. The plate 24 is further provided with outwardly projecting spaced pintles 42 adapted to receive pintles 44 positioned on the inner edge of the body member 38. A pin 46 is adapted to extend through the pintles 42, 44 such that the body member 38 is hingedly connected to the first plate 24.

The outer edge of the body member 38 is appropriately shaped to receive a second plate 48 in the open slot 40. Such second plate 48 is generally formed from a body portion or tongue 50 of generally triangular configuration which extends into the slot 40 and is fixed in position by a series of bolts and nuts 52 extending through aligned holes (not shown) extending through the panels 38 and the inner portions of the second plate body portion 50. In this regard, the lower portion of the body member 36 is not provided with an open slot 40 but either provided with a lower member welded to both the panels 38 or configured so as to form, a shelf 54 upon which the lower edge 56 of the tongue 50 is adapted to rest. The outer edge of the tongue 50 is provided with a outer planar surface 58 disposed at right angles thereto and adapted to in turn support the ends of the rigid anchoring platform 20 in contact therewith. In that regard, the second plate outer surface 58 is either provided with bolt openings (not shown) or the anchoring platform 20 is welded directly thereto once it has been placed in aligned positioned as will hereinafter be explained.

Once the pair of bracket assemblies 10 have been mounted upon adjacent spaced I-beams 12, the rigid anchoring platform 20 may be positioned so as to span the space between the I-beams and rest upon the second platform 58 at each end thereof. In this regard, it should be pointed out that if either of the I-beams 12 are not in the same plane, that is, if the outer surface of one of the I-beams, or both for that matter are canted with respect to each other, that such misalignment can be easily be corrected by pivoting one or both of the second plates with respect to its supporting first plate until such alignment is corrected, that is, presents a square surface at either end of the anchoring platform. With the present technology if the I-beams are canted with respect to each other, a hit or miss welding sequence with triangular brackets must be performed prior to arriving at such a square supporting position. The angle which the second plate outer planar surface 58 makes with the first plate 24 is, of course, fixed for any configuration plate 48 but since the plate is removable, various angled faces such as face **58*a* can be provided simply by using a plate 48*a* having a different angled face. It should also be pointed out that the second plate 48 and the body member 36 could be integrally formed which, of course, would require that entire integral unit to be changed if a different angle planar surface 58 were desired. Also the extent of the surface 58 could be reduced from that illustrated in area so long as it provided adequate support to the rigid platform 20**.

Thereafter the rod 16 is manipulated such that the threaded end 17 projects through the hole 22 and thereafter the bolt 18 tightened such that tension is brought to bear against the I-beams 12 such that the plates or boards 60 extending between the I-beams 12 and projecting into the open ends 62 thereof are in turn forced up against the wall W so as to insure that wall does not collapse at this area of the excavation. This procedure may be repeated at a number of positions around the excavation as required for safety purposes. After the foundation or other construction has been completed, the site can be back filled and the brackets reused simply by breaking the weld or other attachment between them an the rigid anchoring platform 20 and lifting them out of their mechanical interlock with the I-beams. This assures that the bracket assemblies can be reused without undue refitting or reconstruction.

While there is shown and described herein certain specific structure embodying this invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. An anchoring system for an upright retaining wall laterally disposed between laterally spaced upright beams having flat outer faces comprising a pair of brackets, each bracket comprising a vertically oriented generally planar first plate having inner and outer faces, said first plate having means outwardly extending from said inner face for at least temporarily supporting said bracket upon the face of said beams, a body mounted on said first plate and projecting outwardly from the exterior surface thereof in a place generally normal to said exterior surface, said body further mounted on said first plate for at least limited pivotal motion therewith, said body having a second plate fixedly attached thereto and disposed on the body side distal from its connection with said first plate, said second plate having an outer planar surface disposed at an acute angle to said first plate, wherein appropriate pivoting of said bodies with respect to the first plates of a pair of brackets mounted on said pair of spaced beams disposes said second plates in the same angular plane, a rigid anchoring platform fixedly mounted on said second plates and extending laterally between said beams, a ground retaining wall extending between said pair of beams, a ground anchor disposed behind and generally below said wall, and a cable having opposite ends attached to said platform at a point intermediate its connection with said second plates at one end thereof and to said anchor at the opposite end thereof.

2. The anchoring system of claim 1, said means for temporarily supporting said first plate being a plurality of outwardly downwardly extending hooks adapted to project into openings formed in the outer face of the beam.

3. The anchoring system of claim 1, said pivotal connection between said first plate and said body being a hinge connection, said first plate outer surface and the inner side of said body including cooperating hinge pintles and a hinge pin adapted to connect said pintles.

4. The anchoring system of claim 1, said second plate removably attached to said body.

5. The anchoring system of claim 4, said body including opposed panels exhibiting an open slot proximal said second plate, said second plate in turn having an inwardly extending tongue adapted to extend into said slot and bolt means for connecting said tongue to said panels.

6. The anchoring system of claim 3, said second plate removably attached to said body.

7. The anchoring system of claim 6, said body including opposed panels exhibiting an open slot proximal said second plate, said second plate in turn having an inwardly extending tongue adapted to extend into said slot and bolt means for connecting said tongue to said panels.

8. The method of in situ anchoring a ground retaining wall at an excavation site wherein said wall laterally extends between a pair of upright laterally spaced beams and forward of an anchor buried in the ground behind such wall comprising mounting a bracket on the outerface of each of said beams, said brackets each comprising a vertically oriented generally planar first plate having inner and outer faces, said first plate having means outwardly extending from said inner face for at least temporarily supporting said bracket upon the face of said beams, a body mounted on said first plate and projecting outwardly from the exterior surface thereof in a plane generally normal to said exterior surface, said body further mounted on said first plate for at least limited pivotal motion therewith, said body having a second plate fixedly attached thereto and disposed on the body side distal from its connection with said first plate, said second plate having an outer planar surface disposed at an acute angle to said first plate, temporarily positioning a rigid anchoring platform on said second plate outer surfaces so as to extend between said beams, pivoting one or both of said bodies with respect to said first plates such that said second plate outer surfaces and said platform are in the same plane and thereafter fixedly attaching said platform to said second plates, and connecting a cable from said ground anchor to said platform at a point thereat intermediate the points where said platform is supported by said brackets and thereafter tightening said cable so as to tension said wall against the ground via said beams, brackets, and platform.

* * * * *